US012522895B2

(12) United States Patent
Guo et al.

(10) Patent No.: US 12,522,895 B2
(45) Date of Patent: Jan. 13, 2026

(54) ALUMINUM ALLOY AND ALUMINUM ALLOY STRUCTURAL MEMBER

(71) Applicant: BYD COMPANY LIMITED, Guangdong (CN)

(72) Inventors: Qiang Guo, Shenzhen (CN); Mengde Wang, Shenzhen (CN); Wei An, Shenzhen (CN)

(73) Assignee: BYD Company Limited, Shenzhen (CN)

( * ) Notice: Subject to any disclaimer, the term of this patent is extended or adjusted under 35 U.S.C. 154(b) by 398 days.

(21) Appl. No.: 18/212,659

(22) Filed: Jun. 21, 2023

(65) Prior Publication Data

US 2023/0332277 A1 Oct. 19, 2023

Related U.S. Application Data

(63) Continuation of application No. PCT/CN2021/075052, filed on Feb. 3, 2021.

(30) Foreign Application Priority Data

Dec. 24, 2020 (CN) ..... 202011550093.7

(51) Int. Cl.
*C22C 21/02* (2006.01)
*C22F 1/043* (2006.01)

(52) U.S. Cl.
CPC ..... *C22C 21/02* (2013.01); *C22F 1/043* (2013.01)

(58) Field of Classification Search
CPC ..... C22C 21/02; C22F 1/043
See application file for complete search history.

(56) References Cited

U.S. PATENT DOCUMENTS 3,856,360 A 12/1974 Lindberg et al.

FOREIGN PATENT DOCUMENTS

| | | | |
|---|---|---|---|
| CN | 103710586 | A | 4/2014 |
| CN | 105088033 | A | 11/2015 |
| CN | 105220029 | A | 1/2016 |
| CN | 105296818 | A | 2/2016 |
| CN | 106987744 | A | 7/2017 |
| CN | 107245612 | A | 10/2017 |
| CN | 108559881 | A | 9/2018 |
| CN | 108707788 | A | 10/2018 |
| CN | 108977702 | A | 12/2018 |
| CN | 110184508 | A | 8/2019 |
| CN | 110396628 | A | 11/2019 |
| CN | 110527871 | A | 12/2019 |
| CN | 110551924 | A | 12/2019 |
| CN | 111041290 | A | 4/2020 |
| CN | 111979455 | A | 11/2020 |
| JP | 2008-001954 | A | 1/2008 |

OTHER PUBLICATIONS

International Search Report and Written Opinion for Application No. PCT/CN2021/075052, mailed on Sep. 26, 2021, 9 pages.

*Primary Examiner* — Jessee R Roe
(74) *Attorney, Agent, or Firm* — Sheppard Mullin Richter & Hampton LLP

(57) ABSTRACT

The present disclosure discloses an aluminum alloy, based on a total mass of the aluminum alloy, including: 9-12% Si; 3.0-5.0% Zn; 1.5-2.6% Cu; 0.4-0.9% Mn; 0.2-0.6% Mg; 0.1-0.25% Fe; 0.03-0.35% Zr; 0.05-0.2% Ti; 0.005-0.04% Sr; 0.01-0.02% Ga; 0.005-0.01% Mo; 0.001-0.02% Cr; 0.005-0.3% Ni; 78.01-85.624% Al; and an impurity element.

17 Claims, No Drawings

ALUMINUM ALLOY AND ALUMINUM ALLOY STRUCTURAL MEMBER

CROSS-REFERENCE TO RELATED APPLICATIONS

This application is a Continuation Application of International Patent Application No. PCT/CN2021/075052, filed on Feb. 3, 2021, which is based on and claims priority to and benefits of Chinese Patent Application No. 202011550093.7, filed on Dec. 24, 2020, and entitled "ALUMINUM ALLOY AND ALUMINUM ALLOY STRUCTURAL MEMBER". The entire content of all of the above-referenced applications is incorporated herein by reference.

FIELD

The present disclosure belongs to the technical field of aluminum alloys, and particularly, relates to an aluminum alloy and an aluminum alloy structural member.

BACKGROUND

Current frequently used Al—Si—Cu alloy ADC12 has desirable material flow formability, a large molding process window, and high cost-effectiveness, and is widely used for aluminum alloy die-casting products. ADC12 has advantages such as a low density and a high specific strength, which may be used for die-casting housings, small-sized thin products, supports, or the like. However, die-casting products made from ADC12 have a moderate strength, a tensile strength in a range of 230 MPa to 250 MPa and an elongation at break less than 3%. Therefore, problems such as product deformation easily occur, resulting in difficulty in satisfying future strength requirements for products such as mobile phones and notebook computers. In addition, although Al—Zn aluminum alloys have excellent mechanical properties, but the Al—Zn aluminum alloys have a low die-casting performance, a low production yield, and high product costs.

Therefore, the related art of aluminum alloys still needs improvements.

SUMMARY

The present disclosure resolves at least one of the technical problems in the related art. The present disclosure provides an aluminum alloy with a high strength, desirable ductility, and suitable to make with die-casting techniques.

An aluminum alloy, based on a total mass of the aluminum alloy, the aluminum alloy includes: 9-12% Si; 3.0-5.0% Zn; 1.5-2.6% Cu; 0.4-0.9% Mn; 0.2-0.6% Mg; 0.1-0.25% Fe; 0.03-0.35% Zr; 0.05-0.2% Ti; 0.005-0.04% Sr; 0.01-0.02% Ga; 0.005-0.01% Mo; 0.001-0.02% Cr; 0.005-0.3% Ni; 78.01-85.624% Al; and impurity elements.

An aluminum alloy structural member is provided. According to an embodiment of the present disclosure, the aluminum alloy structural member includes the above aluminum alloy. The aluminum alloy structural member has all characteristics and advantages of the above aluminum alloy, which are not repeated herein.

Additional aspects and advantages of the present disclosure are provided in the following description, some of which will become apparent from the following description or may be learned from practices of the present disclosure.

DETAILED DESCRIPTION

Embodiments of the present disclosure are described in detail below, and examples of the embodiments are shown in the drawings, where the same or similar elements or the elements having the same or similar functions are represented by the same or similar reference numerals throughout the description. The embodiments described below with reference to the drawings are examples and used only for explaining the present disclosure, and should not be construed as a limitation on the present disclosure.

The present disclosure provides an aluminum alloy, based on a total mass of the aluminum alloy, including: 9-12% Si; 3.0-5.0% Zn; 1.5-2.6% Cu; 0.4-0.9% Mn; 0.2-0.6% Mg; 0.1-0.25% Fe; 0.03-0.35% Zr; 0.05-0.2% Ti; 0.005-0.04% Sr; 0.01-0.02% Ga; 0.005-0.01% Mo; 0.001-0.02% Cr; 0.005-0.3% Ni; 78.01-85.624% Al; and inevitable impurity elements. In the aluminum alloy, composition and content of alloy elements are configured, so that the aluminum alloy has advantages such as desirable ductility and suitable to make with die-casting techniques while possessing a high strength, which is applicable to structural members that require a high strength and toughness, such as 3C product structural members and automotive load-bearing structural members. In some embodiments, the aluminum alloy, based on a total mass of the aluminum alloy, including: 9-12% Si; 3.0-5.0% Zn; 1.5-2.6% Cu; 0.4-0.9% Mn; 0.2-0.6% Mg; 0.1-0.25% Fe; 0.03-0.35% Zr; 0.05-0.2% Ti; 0.005-0.04% Sr; 0.01-0.02% Ga; 0.005-0.01% Mo; 0.001-0.02% Cr; 0.005-0.3% Ni; up to 0.02% inevitable impurity elements, and balanced with Al.

In the aluminum alloy of the present disclosure, the content of Si is in the range of 9-12%. For example, the content of Si may be 9.0%, 9.5%, 10%, 10.5%, 11%, 11.5%, 12%, or the like. The content of Si may be in a range of 10-12%. As a secondary main component of the aluminum alloy in the present disclosure, Si can improve the fluidity of the aluminum alloy and can enhance the strength of the aluminum alloy without affecting the thermal conductivity of the aluminum alloy. In the above aluminum alloy in the present disclosure, when the Si content is in the above range, the fluidity of the aluminum alloy satisfies the casting requirements, and the aluminum alloy can generate $Mg_2Si$ and $Al_{12}Fe_3Si$ strengthening phases with Mg and Fe, which helps improve the mechanical properties of the aluminum alloy.

In the aluminum alloy of the present disclosure, the content of Zn is in the range of 3.0-5.0%. For example, the content of Zn may be 3.0%, 3.5%, 4.0%, 4.5%, 5.0%, or the like. For example, the content of Zn may be in a range of 3.5-5.0%. In the above aluminum alloy in this application, when the content of Zn is in the above range, Zn can effectively dissolve a solid solution formed in $\alpha$(Al) to enhance the mechanical properties of the aluminum alloy, improve the machining properties of the aluminum alloy, and improve the flow formability of the aluminum alloy.

In the aluminum alloy of the present disclosure, the content of Cu is in the range of 1.5-2.6%. For example, the content of Cu may be 1.5%, 1.8%, 2.0%, 2.3%, 2.6%, or the like. In the aluminum alloy of the present disclosure, when the content of Cu is in the above range, Cu can form a solid solution phase with Al, and the precipitated $Al_2Cu$ phase is dispersed at grain boundaries of the aluminum alloy. The precipitated phase is a strengthening phase, which can improve the strength and toughness of the aluminum alloy. However, when the Cu content is excessively high, the elongation at break of the aluminum alloy will be affected.

In the aluminum alloy of the present disclosure, the content of Mn is in the range of 0.4-0.9%. The content of Mn may be 0.4%, 0.5%, 0.6%, 0.7%, 0.8%, 0.9%, or the like. The content of Cr is in the range of 0.001-0.02%. For example, the content of Cr may be 0.001%, 0.005%, 0.01%, 0.015%, 0.02%, or the like. In the above aluminum alloy of the present disclosure, when the contents of Mn and Cr are in the above ranges, Mn and Cr can be dissolved into an Al alloy substrate, which strengthens the aluminum alloy substrate, and suppresses the grain growth of primary Si and α-Al, so that the primary Si is dispersed among grains and provides the function of dispersion strengthening, thereby improving the strength and toughness of the aluminum alloy. Most Mn segregates to the grain boundaries of the aluminum alloy and is combined with Fe to form a needle shaped AlFeMnSi phase, thereby improving the overall strength of the aluminum alloy. However, when the Mn content is excessively high, a large number of needle-shaped structures are formed, which will cause cutting of the aluminum alloy substrate. As a result, the toughness of the aluminum alloy decreases.

In the aluminum alloy of the present disclosure, the content of Mg is in the range of 0.2-0.6%. For example, the content of Mg may be 0.2%, 0.3%, 0.4%, 0.5%, 0.6%, or the like. Mg with the content in the above range can combine with Zn to form an $MgZn_2$ strengthening phase, which is uniformly dispersed at the grain boundaries of the aluminum alloy, so that the grain boundaries of the aluminum alloy can be improved, which can ensure the strength and toughness of the aluminum alloy.

In the aluminum alloy of the present disclosure, the content of Fe is in the range of 0.1-0.25%. For example, the content of Fe may be 0.1%, 0.15%, 0.2%, 0.25%, or the like. When the Fe content is in the above range, the stickiness of the aluminum alloy during die-casting molding can be reduced. However, when the Fe content is excessively high, needle-shaped substances are formed, which increases heat conduction and reduces the thermal conductivity of the aluminum alloy.

In the aluminum alloy of the present disclosure, the content of Zr is in the range of 0.03-0.35%. For example, the content of Zr may be 0.03%, 0.05%, 0.1%, 0.15%, 0.2%, 0.25%, 0.3%, 0.35%, or the like. Zr with the content in the above range can be dissolved in the aluminum alloy substrate, forming an $Al_3Zr$ coarse phase, a β'($Al_3Zr$) metastable phase, and an $Al_3Zr(DO_{23})$ equilibrium phase in the aluminum alloy, which can improve the strength, toughness, and corrosion resistance of the aluminum alloy.

In the aluminum alloy of the present disclosure, the content of Ti is in the range of 0.05-0.2%. For example, the content of Ti may be 0.05%, 0.06%, 0.07%, 0.08%, 0.09%, 0.12%, 0.15%, 0.2%, or the like. When the Ti content is in the above range, the following functions can be realized. First, the grains can be refined, so that the aluminum alloy obtains a high strength and elongation at break and a low coefficient of thermal expansion, and has desirable die-casting formability. Second, intermetallic compounds can be formed in the aluminum alloy, which causes complex changes in the structure of the aluminum alloy, thereby improving the strength of the alloy. Third, Ti after a heat treatment process can be dissolved into an α-Al solid solution to a certain extent, which causes precipitation strengthening after aging treatment, thereby improving the strength of the aluminum alloy.

In the aluminum alloy of the present disclosure, the content of Sr is in the range of 0.005-0.04%, the content of Ga is in the range of 0.01-0.02%, and the content of Mo is in the range of 0.005-0.01%. For example, the content of Sr may be 0.005%, 0.01%, 0.02%, 0.03%, 0.04%, or the like, the content of Ga may be 0.01%, 0.15%, 0.02%, or the like, and the content of Mo may be 0.005%, 0.007%, 0.009%, 0.01%, or the like. When Sr, Ga, and Mo in the aluminum alloy are in the above ranges, Sr can significantly improve the internal structure of the aluminum alloy while refining eutectic silicon, Ga can increase the nucleation rate, reduce the nucleation growth rate, and optimize the intergranular structure, and Mo can form an $Mo_3Al_8$ strengthening phase with the substrate Al in the aluminum alloy. Through the joint effects of Sr, Ga, and Mo, an aluminum alloy with a high strength and a desirable thermal conductivity can be obtained. According to the embodiments of the present disclosure, when the Si content is greater than 10%, the $Mo_3Al_8$ phase can react with a large amount of Si to generate second phase products of $MoSi_2$, $Mo(Si, Al)_2$, $Mo(Si, Al)_2$, $Mo_5Si_3$, and $Mo(Al, Si)_3$. The second phase products have desirable high-temperature oxidation resistance and can provide dispersion strengthening and toughening, thereby improving the strength and toughness of the aluminum alloy.

In the aluminum alloy of the present disclosure, the content of Ni is in the range of 0.005-0.3%. For example, the content of Ni may be 0.005%, 0.01%, 0.02%, 0.03%, or the like. In the above aluminum alloy of the present disclosure, the Ni content is in the above range, which can improve the high-temperature mechanical properties of the aluminum alloy. Moreover, since the solid solubility of Ni in the aluminum alloy is small, Ni-rich phase particles are easily precipitated from the aluminum substrate when re-saturated. In the aluminum alloy of the present disclosure including the Ni element with the above content, stable Ni-rich phases with complex grain structures, such as $Al_3Ni$, $Al_7Cu_4Ni$, and $Al_3CuNi$ can be formed, which helps improve the strength and elongation at break of the alloy material. However, when Ni has an excessive content greater than 0.3%, the thermal conductivity and fluidity of the material are reduced, resulting in early fracture of the material under stress, and affecting the tensile strength and elongation at break of the material. In addition, if the Ni content is in the above range, Ni can further form precipitated phases such as $Al_9FeNi$ with the Fe element, thereby preventing generation of Fe needle-shaped substances in the aluminum alloy of the present disclosure.

According to the embodiments of the present disclosure, the aluminum alloy of the present disclosure includes Er, the content of Er is in the range of 0-0.35%. For example, the content of Er may be 0.005%, 0.01%, 0.05%, 0.1%, 0.15%, 0.2%, 0.25%, 0.3%, 0.35%, or the like. In the present disclosure, the rare earth Er provides heterogeneous nucleation during solidification, and is mainly distributed in the α(Al) phase, the phase boundaries, the grain boundaries, and the interdendritic segregation of the aluminum alloy, which refines the dendrite structures and grains, thereby strengthening the aluminum alloy. Most of the Er segregates at the grain boundaries of the alloy, and some exist in the form of compounds ($Al_3Er$ and the like), and are dispersed in the substrate, which provides dispersion strengthening. Under the condition of no more than 0.35% rare earth Er, the yield and tensile strength of the aluminum alloy increase with the increase of the Er content.

According to the embodiments of the present disclosure, a ratio of the Zr content to the Ti content may be in a range of (2-6):1, and for example, may be 2:1, 3:1, 4:1, 5:1, 6:1, or the like. In the aluminum alloy of the present disclosure, both Ti and Zr elements can refine grains. Therefore, addition of Ti and Zr alone can provide grain refining for the alloy. When both Ti and Zr are added and the ratio of the Zr content to Ti the content is in the range of (2-6): 1, the refining effect for the aluminum alloy is significantly better than that generated by adding Ti and Zr in an equal amount alone. This is because when both Ti and Zr are added, not only $Al_3Zr$ and $Al_3Ti$ particles that exist when Ti and Zr are added alone can be used as nucleation points, but also a large number of $Al_3(Ti, Zr)$ complex nucleation cores are formed. These particles jointly promote strong grain refinement. With the increase of the composite content of Ti and Zr, the number of nucleation cores continuously increases, which provides increasingly strong refinement for the alloy. Therefore, the grain size refinement and mechanical properties of the alloy are further increased.

According to the embodiments of the present disclosure, a ratio of the Zn content to the Cu content may be in a range of (1.2-2.5):1, and for example, may be 1.2:1, 1.4:1, 1.6:1, 1.9:1, 2.2:1, 2.4:1, or the like. Through extensive experimental research, the applicant of the preset disclosure found that when Cu and Zn in the aluminum alloy are in the above proportion ranges, Cu and Zn form a CuZn binding phase, which can effectively improve the strength of the aluminum alloy and can ensure the elongation at break of the aluminum alloy.

According to the embodiments of the present disclosure, when the content of Zr in the aluminum alloy is greater than or equal to 0.05%, a ratio of the Er content to the Zr content may be in a range of (0.01-0.5):1, and for example, may be 0.01:1, 0.05:1, 0.1:1, 0.2:1, 0.3:1, 0.4:1, 0.5:1, or the like. When Er and Zr in the aluminum alloy are in the above proportion ranges, the aluminum alloy has desirable stability, and has a significantly increased yield strength, and can retain the elongation at break. According to preliminary analysis, the reason may be that an atomic radius of Er is close to that of Zr, both can effectively refine the grains, and Er can combine with Al to form an $Al_3Er$ phase and can combine with Zr to form an $Al_3(ZrxEr_{1-x})$ phase with better thermal stability. Therefore, the strength of the aluminum alloy can be improved, and it can be ensured that the elongation at break does not decrease. In addition, with the increase of Zr, the natural aging stabilization time of the aluminum alloys decreases, and the stability of the aluminum alloys increases.

According to the embodiments of the present disclosure, the aluminum alloy is a die-casting aluminum alloy, which has a high strength and a desirable compactness, and can be integrally formed without a need of CNC reprocessing, so that the costs are low.

According to the embodiments of the present disclosure, the aluminum alloy further includes inevitable impurities. A content of a single element in the inevitable impurities is not greater than 0.01%, and a total content of the inevitable impurities is not greater than 0.02%. Since it is difficult to achieve a raw material purity of 100%, and impurities may be introduced during the preparation, the aluminum alloy usually includes inevitable impurities (such as B, Ca, and Hf). When the impurities is not greater than the above range, it can ensure that the various properties of the aluminum alloy satisfy the requirements and no negative impact is exerted on the aluminum alloy.

According to the embodiments of the present disclosure, the tensile strength of the aluminum alloy is not less than 380 MPa, and for example, may be 380 MPa, 390 MPa, 400 MPa, 410 MPa, 420 MPa, 430 MPa, 440 MPa, or the like. The yield strength is not less than 260 MPa, and for example, may be 260 MPa, 270 MPa, 280 MPa, 290 MPa, 300 MPa, 310 MPa, or the like. The elongation at break is not less than 4%, and for example, may be 4%, 4.5%, 5%, 5.5%, 6%, 6.5%, 7%, or the like. The thermal conductivity is not less than 130 W/(m K), and for example, may be 130 W/(m K), 135 W/(m K), 140 W/(m K), 145 W/(m K), 150 W/(m K), or the like. The die-casting fluidity is not less than 90%, and for example, may be 95%, 98%, 100%, 102%, 105%, 108%, 110%, or the like. Therefore, the aluminum alloy has a desirable strength, plasticity, thermal conductivity, and die-casting formability, which can be effectively used in manufacturing of 3C product structural members, automotive load-bearing structural members, and the like.

According to the embodiments of the present disclosure, the yield strength of the aluminum alloy is in a range of 260-310 Mpa, the tensile strength is in a range of 380-440 Mpa, the elongation at break is in a range of 4-7%, the die-casting fluidity is not less than 90%, and the thermal conductivity is in a range of 130-150 W/(m K).

The present disclosure provides an aluminum alloy structural member. According to an embodiment of the present disclosure, at least a part of the aluminum alloy structural member is formed by the above aluminum alloy. The aluminum alloy structural member has all characteristics and advantages of the above aluminum alloy, which are not repeated herein.

In the embodiments of the present disclosure, the aluminum alloy structural member includes at least one of a 3C product structural member and an automotive load-bearing structural member. For example, the aluminum alloy structural member may be a phone middle frame, a phone back cover, a phone middle plate, or the like. Therefore, the structural member has a desirable mechanical strength, plasticity, and die-casting performance, which can satisfy requirements of users for a high product strength, thereby improving the user experience.

Embodiments of the present disclosure are described below in detail.

Embodiments 1-51

As shown in Table 1, the components of the aluminum alloy are measured as follows by mass content: 9-12% Si; 3.0-5.0% Zn; 1.5-2.6% Cu; 0.4-0.9% Mn; 0.2-0.6% Mg; 0.1-0.25% Fe; 0.03-0.35% Zr; 0.05-0.2% Ti; 0.005-0.04% Sr; 0.01-0.02% Ga; 0.005-0.01% Mo; 0.001-0.02% Cr; 0.005-0.3% Ni; 0-0.35% Er; 77.66-85.624% Al; and inevitable impurity elements. A required mass of each intermediate alloy or metal element is calculated according to the mass contents of the components of the above aluminum alloy. Then, each intermediate alloy or metal element is added to a melting furnace for melting, and is stirred evenly to obtain an aluminum alloy liquid. A content of each component is detected and adjusted until the content reaches a required range. Then, a slag remover is added for slag removal, and a refining agent is added for refining and degassing. After completion of the above operations, the slag is removed, and the aluminum alloy liquid is left standstill. Then, the aluminum alloy liquid is cooled and casted into an ingot. After the ingot is cooled, die casting may be performed. Parameters of the die casting may be as follows: a feed temperature in a range of 680-720° C., a die casting machine speed in a range of 1.6-2 m/s, and an insulation time in a range of 1-3 s. In this way, an aluminum alloy die cast is obtained.

Comparative Examples 1-18

The same method as described in the embodiments is used to prepare a die-casting aluminum alloy, except that an aluminum alloy raw material is prepared according to the composition in Table 1.

TABLE 1

| | Si | Zn | Cu | Mn | Mg | Fe | Zr | Ti | Sr | Ga | Mo | Cr | Ni | Er | Zr:Ti | Zn:Cu | Er:Zr | | Aluminum and inevitable impurities |
|---|---|---|---|---|---|---|---|---|---|---|---|---|---|---|---|---|---|---|---|
| Embodiment 1 | 10 | 4 | 2 | 0.7 | 0.4 | 0.2 | 0.2 | 0.07 | 0.02 | 0.013 | 0.008 | 0.015 | 0.01 | 0.08 | 2.86 | 2.00 | 0.4 | — | 82.284 |
| Embodiment 2 | 9 | 4 | 2 | 0.7 | 0.4 | 0.2 | 0.2 | 0.07 | 0.02 | 0.013 | 0.008 | 0.015 | 0.01 | 0.08 | 2.86 | 2.00 | 0.4 | — | 83.284 |
| Embodiment 3 | 12 | 4 | 2 | 0.7 | 0.4 | 0.2 | 0.2 | 0.07 | 0.02 | 0.013 | 0.008 | 0.015 | 0.01 | 0.08 | 2.86 | 2.00 | 0.4 | — | 80.284 |
| Comparative example 1 | 8 | 4 | 2 | 0.7 | 0.4 | 0.2 | 0.2 | 0.07 | 0.02 | 0.013 | 0.008 | 0.015 | 0.01 | 0.08 | 2.86 | 2.00 | 0.4 | — | 84.284 |
| Comparative example 2 | 14 | 4 | 2 | 0.7 | 0.4 | 0.2 | 0.2 | 0.07 | 0.02 | 0.013 | 0.008 | 0.015 | 0.01 | 0.08 | 2.86 | 2.00 | 0.4 | — | 78.284 |
| Embodiment 4 | 10 | 3 | 2 | 0.7 | 0.4 | 0.2 | 0.2 | 0.07 | 0.02 | 0.013 | 0.008 | 0.015 | 0.01 | 0.08 | 2.86 | 1.50 | 0.4 | — | 83.284 |
| Embodiment 5 | 10 | 5 | 2 | 0.7 | 0.4 | 0.2 | 0.2 | 0.07 | 0.02 | 0.013 | 0.008 | 0.015 | 0.01 | 0.08 | 2.86 | 2.50 | 0.4 | — | 81.284 |
| Comparative example 3 | 10 | 1 | 2 | 0.7 | 0.4 | 0.2 | 0.2 | 0.07 | 0.02 | 0.013 | 0.008 | 0.015 | 0.01 | 0.08 | 2.86 | 0.50 | 0.4 | — | 85.284 |
| Embodiment 6 | 10 | 4 | 1.5 | 0.7 | 0.4 | 0.2 | 0.2 | 0.07 | 0.02 | 0.013 | 0.008 | 0.015 | 0.01 | 0.08 | 2.86 | 2.67 | 0.4 | — | 82.784 |
| Embodiment 7 | 10 | 4 | 1.7 | 0.7 | 0.4 | 0.2 | 0.2 | 0.07 | 0.02 | 0.013 | 0.008 | 0.015 | 0.01 | 0.08 | 2.86 | 2.35 | 0.4 | — | 82.584 |
| Embodiment 8 | 10 | 4 | 2.3 | 0.7 | 0.4 | 0.2 | 0.2 | 0.07 | 0.02 | 0.013 | 0.008 | 0.015 | 0.01 | 0.08 | 2.86 | 1.74 | 0.4 | — | 81.984 |
| Embodiment 9 | 10 | 4 | 2.5 | 0.7 | 0.4 | 0.2 | 0.2 | 0.07 | 0.02 | 0.013 | 0.008 | 0.015 | 0.01 | 0.08 | 2.86 | 1.60 | 0.4 | — | 81.784 |
| Comparative example 4 | 10 | 4 | 1.0 | 0.7 | 0.4 | 0.2 | 0.2 | 0.07 | 0.02 | 0.013 | 0.008 | 0.015 | 0.01 | 0.08 | 2.86 | 4.00 | 0.4 | — | 83.284 |
| Comparative example 5 | 10 | 4 | 3.0 | 0.7 | 0.4 | 0.2 | 0.2 | 0.07 | 0.02 | 0.013 | 0.008 | 0.015 | 0.01 | 0.08 | 2.86 | 1.33 | 0.4 | — | 81.284 |
| Embodiment 10 | 10 | 4 | 2 | 0.4 | 0.4 | 0.2 | 0.2 | 0.07 | 0.02 | 0.013 | 0.008 | 0.015 | 0.01 | 0.08 | 2.86 | 2.00 | 0.4 | — | 82.584 |
| Embodiment 11 | 10 | 4 | 2 | 0.5 | 0.4 | 0.2 | 0.2 | 0.07 | 0.02 | 0.013 | 0.008 | 0.015 | 0.01 | 0.08 | 2.86 | 2.00 | 0.4 | — | 82.484 |
| Embodiment 12 | 10 | 4 | 2 | 0.8 | 0.4 | 0.2 | 0.2 | 0.07 | 0.02 | 0.013 | 0.008 | 0.015 | 0.01 | 0.08 | 2.86 | 2.00 | 0.4 | — | 82.184 |
| Embodiment 13 | 10 | 4 | 2 | 0.9 | 0.4 | 0.2 | 0.2 | 0.07 | 0.02 | 0.013 | 0.008 | 0.015 | 0.01 | 0.08 | 2.86 | 2.00 | 0.4 | — | 82.084 |
| Comparative example 6 | 10 | 4 | 2 | 1.0 | 0.4 | 0.2 | 0.2 | 0.07 | 0.02 | 0.013 | 0.008 | 0.015 | 0.01 | 0.08 | 2.86 | 2.00 | 0.4 | — | 81.984 |
| Embodiment 14 | 10 | 4 | 2 | 0.7 | 0.2 | 0.2 | 0.2 | 0.07 | 0.02 | 0.013 | 0.008 | 0.015 | 0.01 | 0.08 | 2.86 | 2.00 | 0.4 | — | 82.484 |
| Embodiment 15 | 10 | 4 | 2 | 0.7 | 0.3 | 0.2 | 0.2 | 0.07 | 0.02 | 0.013 | 0.008 | 0.015 | 0.01 | 0.08 | 2.86 | 2.00 | 0.4 | — | 82.384 |
| Embodiment 16 | 10 | 4 | 2 | 0.7 | 0.5 | 0.2 | 0.2 | 0.07 | 0.02 | 0.013 | 0.008 | 0.015 | 0.01 | 0.08 | 2.86 | 2.00 | 0.4 | — | 82.184 |
| Embodiment 17 | 10 | 4 | 2 | 0.7 | 0.6 | 0.2 | 0.2 | 0.07 | 0.02 | 0.013 | 0.008 | 0.015 | 0.01 | 0.08 | 2.86 | 2.00 | 0.4 | — | 82.084 |
| Comparative example 7 | 10 | 4 | 2 | 0.7 | 0.7 | 0.2 | 0.2 | 0.07 | 0.02 | 0.013 | 0.008 | 0.015 | 0.01 | 0.08 | 2.86 | 2.00 | 0.4 | — | 81.984 |
| Embodiment 18 | 10 | 4 | 2 | 0.7 | 0.4 | 0.1 | 0.2 | 0.07 | 0.02 | 0.013 | 0.008 | 0.015 | 0.01 | 0.08 | 2.86 | 2.00 | 0.4 | — | 82.384 |
| Embodiment 19 | 10 | 4 | 2 | 0.7 | 0.4 | 0.25 | 0.2 | 0.07 | 0.02 | 0.013 | 0.008 | 0.015 | 0.01 | 0.08 | 2.86 | 2.00 | 0.4 | — | 82.234 |
| Comparative example 8 | 10 | 4 | 2 | 0.7 | 0.4 | 0 | 0.2 | 0.07 | 0.02 | 0.013 | 0.008 | 0.015 | 0.01 | 0.08 | 2.86 | 2.00 | 0.4 | — | 82.484 |
| Comparative example 9 | 10 | 4 | 2 | 0.7 | 0.4 | 0.3 | 0.2 | 0.07 | 0.02 | 0.013 | 0.008 | 0.015 | 0.01 | 0.08 | 2.86 | 2.00 | 0.4 | — | 82.184 |
| Embodiment 20 | 10 | 4 | 2 | 0.7 | 0.4 | 0.2 | 0.03 | 0.07 | 0.02 | 0.013 | 0.008 | 0.015 | 0.01 | 0.01 | 0.43 | 2.00 | 0.3333 | — | 82.524 |
| Embodiment 21 | 10 | 4 | 2 | 0.7 | 0.4 | 0.2 | 0.06 | 0.07 | 0.02 | 0.013 | 0.008 | 0.015 | 0.01 | 0.02 | 0.86 | 2.00 | 0.3333 | — | 82.484 |
| Embodiment 22 | 10 | 4 | 2 | 0.7 | 0.4 | 0.2 | 0.1 | 0.07 | 0.02 | 0.013 | 0.008 | 0.015 | 0.01 | 0.08 | 1.43 | 2.00 | 0.8 | — | 82.384 |
| Embodiment 23 | 10 | 4 | 2 | 0.7 | 0.4 | 0.2 | 0.15 | 0.07 | 0.02 | 0.013 | 0.008 | 0.015 | 0.01 | 0.08 | 2.14 | 2.00 | 0.5333 | — | 82.334 |
| Embodiment 24 | 10 | 4 | 2 | 0.7 | 0.4 | 0.2 | 0.3 | 0.07 | 0.02 | 0.013 | 0.008 | 0.015 | 0.01 | 0.08 | 4.29 | 2.00 | 0.2667 | — | 82.184 |
| Embodiment 25 | 10 | 4 | 2 | 0.7 | 0.4 | 0.2 | 0.35 | 0.07 | 0.02 | 0.013 | 0.008 | 0.015 | 0.01 | 0.08 | 5.00 | 2.00 | 0.2286 | — | 82.134 |
| Comparative example 10 | 10 | 4 | 2 | 0.7 | 0.4 | 0.2 | 0 | 0.07 | 0.02 | 0.013 | 0.008 | 0.015 | 0.01 | 0.08 | 0.00 | 2.00 | — | — | 82.484 |
| Comparative example 11 | 10 | 4 | 2 | 0.7 | 0.4 | 0.2 | 0.45 | 0.07 | 0.02 | 0.013 | 0.008 | 0.015 | 0.01 | 0.08 | 6.43 | 2.00 | 0.1778 | — | 82.034 |
| Embodiment 26 | 10 | 4 | 2 | 0.7 | 0.4 | 0.2 | 0.35 | 0.05 | 0.02 | 0.013 | 0.008 | 0.015 | 0.01 | 0.08 | 7.00 | 2.00 | 0.2286 | — | 82.154 |

TABLE 1-continued

| | Si | Zn | Cu | Mn | Mg | Fe | Zr | Ti | Sr | Ga | Mo | Cr | Ni | Er | Zr:Ti | Zn:Cu | Er:Zr | | Aluminum and inevitable impurities |
|---|---|---|---|---|---|---|---|---|---|---|---|---|---|---|---|---|---|---|---|
| Embodiment 27 | 10 | 4 | 2 | 0.7 | 0.4 | 0.2 | 0.2 | 0.05 | 0.02 | 0.013 | 0.008 | 0.015 | 0.01 | 0.08 | 4.00 | 2.00 | 0.4 | — | 82.304 |
| Embodiment 28 | 10 | 4 | 2 | 0.7 | 0.4 | 0.2 | 0.2 | 0.09 | 0.02 | 0.013 | 0.008 | 0.015 | 0.01 | 0.08 | 2.22 | 2.00 | 0.4 | — | 82.264 |
| Embodiment 29 | 10 | 4 | 2 | 0.7 | 0.4 | 0.2 | 0.2 | 0.15 | 0.02 | 0.013 | 0.008 | 0.015 | 0.01 | 0.08 | 1.33 | 2.00 | 0.4 | — | 82.204 |
| Embodiment 30 | 10 | 4 | 2 | 0.7 | 0.4 | 0.2 | 0.2 | 0.2 | 0.02 | 0.013 | 0.008 | 0.015 | 0.01 | 0.08 | 1.0 | 2.00 | 0.4 | — | 82.154 |
| Comparative example 12 | 10 | 4 | 2 | 0.7 | 0.4 | 0.2 | 0.2 | 0.3 | 0.02 | 0.013 | 0.008 | 0.015 | 0.01 | 0.08 | 0.67 | 2.00 | 0.4 | — | 82.054 |
| Embodiment 31 | 10 | 4 | 2 | 0.7 | 0.4 | 0.2 | 0.2 | 0.07 | 0.005 | 0.013 | 0.008 | 0.015 | 0.01 | 0.08 | 2.86 | 2.00 | 0.4 | — | 82.299 |
| Embodiment 32 | 10 | 4 | 2 | 0.7 | 0.4 | 0.2 | 0.2 | 0.07 | 0.01 | 0.013 | 0.008 | 0.015 | 0.01 | 0.08 | 2.86 | 2.00 | 0.4 | — | 82.294 |
| Embodiment 33 | 10 | 4 | 2 | 0.7 | 0.4 | 0.2 | 0.2 | 0.07 | 0.03 | 0.013 | 0.008 | 0.015 | 0.01 | 0.08 | 2.86 | 2.00 | 0.4 | — | 82.274 |
| Embodiment 34 | 10 | 4 | 2 | 0.7 | 0.4 | 0.2 | 0.2 | 0.07 | 0.04 | 0.013 | 0.008 | 0.015 | 0.01 | 0.08 | 2.86 | 2.00 | 0.4 | — | 82.264 |
| Comparative example 13 | 10 | 4 | 2 | 0.7 | 0.4 | 0.2 | 0.2 | 0.07 | 0 | 0.013 | 0.008 | 0.015 | 0.01 | 0.08 | 2.86 | 2.00 | 0.4 | — | 82.304 |
| Comparative example 14 | 10 | 4 | 2 | 0.7 | 0.4 | 0.2 | 0.2 | 0.07 | 0.09 | 0.013 | 0.008 | 0.015 | 0.01 | 0.08 | 2.86 | 2.00 | 0.4 | — | 82.214 |
| Embodiment 35 | 10 | 4 | 2 | 0.7 | 0.4 | 0.2 | 0.2 | 0.07 | 0.02 | 0.01 | 0.008 | 0.015 | 0.01 | 0.08 | 2.86 | 2.00 | 0.4 | — | 82.287 |
| Embodiment 36 | 10 | 4 | 2 | 0.7 | 0.4 | 0.2 | 0.2 | 0.07 | 0.02 | 0.018 | 0.008 | 0.015 | 0.01 | 0.08 | 2.86 | 2.00 | 0.4 | — | 82.279 |
| Embodiment 37 | 10 | 4 | 2 | 0.7 | 0.4 | 0.2 | 0.2 | 0.07 | 0.02 | 0.02 | 0.008 | 0.015 | 0.01 | 0.08 | 2.86 | 2.00 | 0.4 | — | 82.277 |
| Comparative example 15 | 10 | 4 | 2 | 0.7 | 0.4 | 0.2 | 0.2 | 0.07 | 0.02 | 0.05 | 0.008 | 0.015 | 0.01 | 0.08 | 2.86 | 2.00 | 0.4 | — | 82.247 |
| Embodiment 38 | 10 | 4 | 2 | 0.7 | 0.4 | 0.2 | 0.2 | 0.07 | 0.02 | 0.013 | 0.005 | 0.015 | 0.01 | 0.08 | 2.86 | 2.00 | 0.4 | — | 82.287 |
| Embodiment 39 | 10 | 4 | 2 | 0.7 | 0.4 | 0.2 | 0.2 | 0.07 | 0.02 | 0.013 | 0.01 | 0.015 | 0.01 | 0.08 | 2.86 | 2.00 | 0.4 | — | 82.282 |
| Comparative example 16 | 10 | 4 | 2 | 0.7 | 0.4 | 0.2 | 0.2 | 0.07 | 0.02 | 0.013 | 0.05 | 0.015 | 0.01 | 0.08 | 2.86 | 2.00 | 0.4 | — | 82.242 |
| Embodiment 40 | 10 | 4 | 2 | 0.7 | 0.4 | 0.2 | 0.2 | 0.07 | 0.02 | 0.013 | 0.008 | 0.005 | 0.01 | 0.08 | 2.86 | 2.00 | 0.4 | — | 82.294 |
| Embodiment 41 | 10 | 4 | 2 | 0.7 | 0.4 | 0.2 | 0.2 | 0.07 | 0.02 | 0.013 | 0.008 | 0.02 | 0.01 | 0.08 | 2.86 | 2.00 | 0.4 | — | 82.279 |
| Comparative example 17 | 10 | 4 | 2 | 0.7 | 0.4 | 0.2 | 0.2 | 0.07 | 0.02 | 0.013 | 0.008 | 0.05 | 0.01 | 0.08 | 2.86 | 2.00 | 0.4 | — | 82.249 |
| Embodiment 42 | 10 | 4 | 2 | 0.7 | 0.4 | 0.2 | 0.2 | 0.07 | 0.02 | 0.013 | 0.008 | 0.015 | 0.03 | 0.08 | 2.86 | 2.00 | 0.4 | — | 82.264 |
| Embodiment 43 | 10 | 4 | 2 | 0.7 | 0.4 | 0.2 | 0.2 | 0.07 | 0.02 | 0.013 | 0.008 | 0.015 | 0.08 | 0.08 | 2.86 | 2.00 | 0.4 | — | 82.214 |
| Embodiment 44 | 10 | 4 | 2 | 0.7 | 0.4 | 0.2 | 0.2 | 0.07 | 0.02 | 0.013 | 0.008 | 0.015 | 0.1 | 0.08 | 2.86 | 2.00 | 0.4 | — | 82.194 |
| Embodiment 45 | 10 | 4 | 2 | 0.7 | 0.4 | 0.2 | 0.2 | 0.07 | 0.02 | 0.013 | 0.008 | 0.015 | 0.2 | 0.08 | 2.86 | 2.00 | 0.4 | — | 82.094 |
| Comparative example 18 | 10 | 4 | 2 | 0.7 | 0.4 | 0.2 | 0.2 | 0.07 | 0.02 | 0.013 | 0.008 | 0.015 | 0.4 | 0.08 | 2.86 | 2.00 | 0.4 | — | 81.894 |
| Embodiment 46 | 10 | 4 | 2 | 0.7 | 0.4 | 0.2 | 0.2 | 0.07 | 0.02 | 0.013 | 0.008 | 0.015 | 0.01 | 0 | 2.86 | 2.00 | 0 | — | 82.364 |
| Embodiment 47 | 10 | 4 | 2 | 0.7 | 0.4 | 0.2 | 0.2 | 0.07 | 0.02 | 0.013 | 0.008 | 0.015 | 0.01 | 0.1 | 2.86 | 2.00 | 0.5 | — | 82.264 |
| Embodiment 48 | 10 | 4 | 2 | 0.7 | 0.4 | 0.2 | 0.2 | 0.07 | 0.02 | 0.013 | 0.008 | 0.015 | 0.01 | 0.2 | 2.86 | 2.00 | 1 | — | 82.164 |
| Embodiment 49 | 10 | 4 | 2 | 0.7 | 0.4 | 0.2 | 0.2 | 0.07 | 0.02 | 0.013 | 0.008 | 0.015 | 0.01 | 0.3 | 2.86 | 2.00 | 1. 5 | — | 82.064 |
| Embodiment 50 | 10 | 4 | 2 | 0.7 | 0.4 | 0.2 | 0.2 | 0.07 | 0.02 | 0.013 | 0.008 | 0.015 | 0.01 | 0.08 | 2.86 | 2.00 | 0.4 | Sn: 0.05 | 82.234 |
| Embodiment 51 | 10 | 4 | 2 | 0.7 | 0.4 | 0.2 | 0.2 | 0.07 | 0.02 | 0.013 | 0.008 | 0.015 | 0.01 | 0.08 | 2.86 | 2.00 | 0.4 | B: 0.03 | 82.254 |

Performance TEST

1. Mechanical property test: The tensile strength, yield strength, and elongation at break are tested in accordance with the "GB/T 228.1-2010 Metallic materials-Tensile testing-Part 1: Method of test at room temperature". The results are shown in Table 2.
2. Die-casting fluidity test:

Test method: Under the same molding condition, sample lengths of a to-be-tested material and a standard material ADC12 in the die-casting process are compared, where die-casting fluidity=length of to-be-tested material/length of standard material, to evaluate the material flow formability.

Test condition: Mosquito coil mold test, atmospheric die-casting, 720° C.

The composition of the standard material ADC12 is Si10Zn0.8Cu1.8Fe0.7Mn0.15Mg0.2.

3. Thermal conductivity test: The aluminum alloy is made into a ϕ12.7×3 mm ingot thermally conductive circular plate, a graphite coating is evenly sprayed on two sides of the to-be-tested sample, and the treated sample is placed into a laser thermal conductivity meter for testing. Laser thermal conductivity test is performed in accordance with the "ASTM E1461 Standard test method for thermal diffusivity by the flash method".

TABLE 2

| | Yield strength (MPa) | Tensile strength (MPa) | Elongation (%) | Die-casting fluidity (%) | Thermal conductivity (%) |
|---|---|---|---|---|---|
| Embodiment 1 | 280 | 423 | 5.21 | 100 | 138 |
| Embodiment 2 | 275 | 416 | 5.33 | 95 | 136 |
| Embodiment 3 | 285 | 425 | 4.93 | 105 | 140 |
| Comparative example 1 | 261 | 368 | 5.8 | 79 | 134 |
| Comparative example 2 | 290 | 365 | 3.12 | 110 | 142 |
| Embodiment 4 | 268 | 420 | 5.22 | 98 | 139 |
| Embodiment 5 | 284 | 426 | 5.19 | 101 | 136 |
| Comparative example 3 | 238 | 359 | 5.3 | 96 | 140 |
| Embodiment 6 | 265 | 400 | 4.9 | 101 | 144 |
| Embodiment 7 | 275 | 414 | 5.12 | 103 | 142 |
| Embodiment 8 | 282 | 420 | 5.3 | 105 | 140 |
| Embodiment 9 | 285 | 424 | 4.07 | 106 | 138 |
| Comparative example 4 | 250 | 370 | 5.91 | 98 | 143 |
| Comparative example 5 | 285 | 325 | 2.25 | 104 | 135 |
| Embodiment 10 | 265 | 400 | 5.68 | 102 | 142 |
| Embodiment 11 | 276 | 412 | 5.72 | 106 | 141 |
| Embodiment 12 | 282 | 423 | 5.2 | 109 | 135 |
| Embodiment 13 | 288 | 389 | 5 | 110 | 134 |
| Comparative example 6 | 291 | 360 | 2.15 | 72 | 131 |
| Embodiment 14 | 260 | 389 | 5.98 | 102 | 147 |
| Embodiment 15 | 263 | 391 | 5.88 | 102 | 145 |
| Embodiment 16 | 267 | 393 | 5.62 | 103 | 136 |
| Embodiment 17 | 270 | 395 | 5.38 | 104 | 135 |
| Comparative example 7 | 270 | 408 | 2.16 | 110 | 132 |
| Embodiment 18 | 272 | 412 | 5.42 | 102 | 143 |
| Embodiment 19 | 283 | 425 | 5.01 | 105 | 141 |
| Comparative example 8 | 242 | 363 | 2.32 | 88 | 145 |
| Comparative example 9 | 284 | 363 | 2.92 | 106 | 138 |
| Embodiment 20 | 260 | 383 | 4.03 | 100 | 145 |
| Embodiment 21 | 263 | 398 | 4.95 | 103 | 145 |
| Embodiment 22 | 267 | 394 | 4.25 | 102 | 143 |
| Embodiment 23 | 275 | 415 | 4.39 | 100 | 142 |
| Embodiment 24 | 282 | 420 | 5.13 | 101 | 136 |
| Embodiment 25 | 283 | 421 | 5.1 | 104 | 134 |

TABLE 2-continued

| | Yield strength (MPa) | Tensile strength (MPa) | Elongation (%) | Die-casting fluidity (%) | Thermal conductivity (%) |
|---|---|---|---|---|---|
| Comparative example 10 | 245 | 372 | 3.92 | 101 | 145 |
| Comparative example 11 | 289 | 388 | 2.22 | 102 | 130 |
| Embodiment 26 | 285 | 385 | 4.01 | 106 | 136 |
| Embodiment 27 | 275 | 415 | 5.1 | 93 | 139 |
| Embodiment 28 | 282 | 424 | 5.25 | 95 | 137 |
| Embodiment 29 | 285 | 425 | 5.21 | 97 | 136 |
| Embodiment 30 | 288 | 428 | 5.16 | 99 | 135 |
| Comparative example 12 | 290 | 398 | 2.25 | 101 | 129 |
| Embodiment 31 | 263 | 398 | 4.25 | 98 | 135 |
| Embodiment 32 | 272 | 409 | 5.03 | 100 | 136 |
| Embodiment 33 | 283 | 424 | 5.23 | 101 | 139 |
| Embodiment 34 | 284 | 425 | 5.22 | 103 | 138 |
| Comparative example 13 | 247 | 375 | 4.02 | 99 | 134 |
| Comparative example 14 | 242 | 330 | 1.25 | 106 | 129 |
| Embodiment 35 | 264 | 399 | 6.32 | 101 | 135 |
| Embodiment 36 | 269 | 404 | 5.93 | 102 | 137 |
| Embodiment 37 | 283 | 419 | 5.19 | 101 | 139 |
| Comparative example 15 | 285 | 345 | 2.12 | 103 | 140 |
| Embodiment 38 | 275 | 413 | 6.03 | 102 | 140 |
| Embodiment 39 | 283 | 425 | 5.63 | 101 | 137 |
| Comparative example 16 | 299 | 360 | 3.29 | 103 | 135 |
| Embodiment 40 | 267 | 400 | 5.25 | 101 | 140 |
| Embodiment 41 | 283 | 423 | 4.82 | 102 | 137 |
| Comparative example 17 | 289 | 368 | 3.02 | 102 | 135 |
| Embodiment 42 | 282 | 423 | 5.32 | 102 | 138 |
| Embodiment 43 | 285 | 425 | 5.41 | 101 | 137 |
| Embodiment 44 | 288 | 429 | 5.25 | 99 | 138 |
| Embodiment 45 | 299 | 389 | 4.98 | 98 | 132 |
| Comparative example 18 | 299 | 359 | 2.3 | 72 | 128 |
| Embodiment 46 | 271 | 399 | 4.88 | 101 | 136 |
| Embodiment 47 | 289 | 424 | 5.98 | 102 | 137 |
| Embodiment 48 | 280 | 429 | 4.32 | 102 | 139 |
| Embodiment 49 | 285 | 420 | 4.01 | 103 | 137 |
| Embodiment 50 | 282 | 422 | 5.23 | 103 | 137 |
| Embodiment 51 | 279 | 423 | 5.12 | 102 | 139 |

It may be learned from the test results in Table 2 that compared to the aluminum alloy outside the element range provided in the present disclosure, the aluminum alloy provided in the present disclosure not only has a high strength, but also has advantages such as desirable ductility and suitable to form with die-casting techniques.

According to the comparative examples 1-18, if the content of each component is not in the range of the present disclosure, the tensile strength, yield strength, the ductility, and the die-casting formability of the aluminum alloy cannot be realized simultaneously. For example, although the comparative example 7, the comparative example 11, and the comparative example 12 have a high tensile strength and a yield strength, their elongations at break are merely about 2.2%, and their toughness is poor, which do not satisfy the demand for products with high strength and toughness.

In conclusion, by configuring the composition and content of the alloy elements, the aluminum alloy in the present disclosure can realize a high tensile strength, a high yield strength, and a high elongation at break simultaneously, and further has desirable die-casting formability, which may be used as structural members with high requirements for strength and toughness.

What is claimed is:

1. An aluminum alloy, based on a total mass of the aluminum alloy, comprising:

9-12% Si;
3.0-5.0% Zn;
1.5-2.6% Cu;
0.4-0.9% Mn;
0.2-0.6% Mg;
0.1-0.25% Fe;
0.03-0.35% Zr;
0.05-0.2% Ti;
0.005-0.04% Sr;
0.01-0.02% Ga;
0.005-0.01% Mo;
0.001-0.02% Cr;
0.005-0.3% Ni;
78.01-85.624% Al; and an impurity element.

2. The aluminum alloy according to claim 1, further comprising Er, wherein a content of Er is in a range of 0-0.35%.

3. The aluminum alloy according to claim 2, wherein a mass ratio between Er and Zr is in a range of (0.01-0.5):1.

4. The aluminum alloy according to claim 1, wherein a mass ratio between Zr and Ti is in a range of (2-6):1.

5. The aluminum alloy according to claim 1, wherein a mass ratio between Zn and Cu is in a range of (1.2-2.5):1.

6. The aluminum alloy according to claim 1, wherein the aluminum alloy is a die-casting aluminum alloy.

7. The aluminum alloy according to claim 1, wherein a yield strength of the aluminum alloy is not less than 260 Mpa;
a tensile strength is not less than 380 Mpa; an elongation at break is not less than 4%;
a die-casting fluidity is not less than 90%; and
a thermal conductivity is not less than 130 W/(m·K).

8. The aluminum alloy according to claim 1, wherein a yield strength of the aluminum alloy is in a range of 260-310 Mpa;
a tensile strength is in a range of 380-440 Mpa;
an elongation at break is in a range of 4-7%;
a die-casting fluidity is not less than 90%; and
a thermal conductivity is in a range of 130-150 W/(m K).

9. An aluminum alloy structural member, wherein the aluminum alloy structural member comprises an aluminum alloy, and based on a total mass of the aluminum alloy, the aluminum alloy comprises:

9-12% Si;
3.0-5.0% Zn;
1.5-2.6% Cu;
0.4-0.9% Mn;
0.2-0.6% Mg;
0.1-0.25% Fe;
0.03-0.35% Zr;
0.05-0.2% Ti;
0.005-0.04% Sr;
0.01-0.02% Ga;
0.005-0.01% Mo;
0.001-0.02% Cr;
0.005-0.3% Ni;
78.01-85.624% Al; and an impurity element.

10. The aluminum alloy structural member according to claim 9, comprising at least one of a 3C product structural member or an automotive load-bearing structural member.

11. The aluminum alloy structural member according to claim 10, wherein a mass ratio between Er and Zr is in a range of (0.01-0.5):1.

12. The aluminum alloy structural member according to claim 9, wherein the aluminum alloy comprises Er, and a content of Er is in a range of 0-0.35%.

13. The aluminum alloy structural member according to claim 9, wherein a mass ratio between Zr and Ti is in a range of (2-6):1.

14. The aluminum alloy structural member according to claim 9, wherein a mass ratio between Zn and Cu is in a range of (1.2-2.5):1.

15. The aluminum alloy structural member according to claim 9, wherein the aluminum alloy is a die-casting aluminum alloy.

16. The aluminum alloy structural member according to claim 9, wherein a yield strength of the aluminum alloy is not less than 260 Mpa; a tensile strength is not less than 380 Mpa; an elongation at break is not less than 4%; a die-casting fluidity is not less than 90%; and a thermal conductivity is not less than 130 W/(m·K).

17. The aluminum alloy structural member according to claim 9, wherein a yield strength of the aluminum alloy is in a range of 260-310 Mpa; a tensile strength is in a range of 380-440 Mpa; an elongation at break is in a range of 4-7%; a die-casting fluidity is not less than 90%; and a thermal conductivity is in a range of 130-150 W/(m K).

* * * * *